US005759086A

United States Patent [19]

Klingel

[11] Patent Number: 5,759,086

[45] Date of Patent: Jun. 2, 1998

[54] METHOD AND MACHINE TOOL FOR CUTTING WORKPIECES

[75] Inventor: Hans Klingel, Möglingen, Germany

[73] Assignee: Trumpf GmbH & Co., Ditzingen, Germany

[21] Appl. No.: 762,543

[22] Filed: Dec. 9, 1996

Related U.S. Application Data

[62] Division of Ser. No. 558,610, Nov. 14, 1995, Pat. No. 5,605,492.

[30] Foreign Application Priority Data

Nov. 4, 1994 [DE] Germany ..... 44 40 631.2

[51] Int. Cl.[6] ..... B24B 1/00

[52] U.S. Cl. ..... 451/28; 451/5; 451/38; 451/40; 451/91; 451/99; 451/102

[58] Field of Search ..... 451/91, 99, 37, 451/40, 102, 38, 39, 5; 83/53, 177

[56] References Cited

U.S. PATENT DOCUMENTS 3,927,150 12/1975 Hart ..... 451/91
4,125,969 11/1978 Easton ..... 451/40
4,249,956 2/1981 Hartman ..... 451/40
4,787,178 11/1988 Morgan et al. ..... 451/38

*Primary Examiner*—Robert A. Rose
*Assistant Examiner*—George Nguyen
*Attorney, Agent, or Firm*—Pepe & Hazard LLP

[57] ABSTRACT

A machine tool for cutting workpieces includes a cutting head with at least two cutting units each providing cutting beams directed at the workpiece so as to impinge thereon closely adjacent each other to cooperate in the cutting action. The machine tool includes a worktable to support the workpiece, and the workpiece and cutting head are relatively movable to provide a cutting line in the workpiece. At least one of the cutting units is movable relative to the other so that the angular relationship of the cutting beams may be varied, and the supply of the cutting medium is separately controlled for the cutting units. In one embodiment the cutting beams are high speed water jets which may contain abrasive and the cutting characteristics of the jets may be varied.

15 Claims, 2 Drawing Sheets

METHOD AND MACHINE TOOL FOR CUTTING WORKPIECES

This is a divisional of application Ser. No. 08/558,610 filed on Nov. 14, 1995, now U.S. Pat. No. 5,605,492.

BACKGROUND OF THE INVENTION

The present invention is directed to a process for cutting workpieces with a cutting beam such as a pressurized water jet, and, more particularly, to such a process wherein the cutting beam is directed at the workpiece to be processed and the workpiece and the cutting beam are moved relative to one another.

Presently available processes and machine tools for practicing the process are used, for example, to cut the workpiece into a number of parts, to cut it with a predetermined contour, and/or to cut predetermined contours into parts formed from the initial workpiece.

For this purpose, according to one known process using a known machine tool, a cutting beam in the form of a pressurized stream of water and the workpiece to be machined are moved in relation to one another crosswise to the cutting beam. In this way, the cutting beam makes a dividing cut of a predetermined length and in a predetermined cutting direction. To increase processing capacity, it is known to use machine tools that have at least two spaced cutting units connected to at least one source of a cutting beam each of which can emit a cutting beam when in operation, and in which the cutting units and the workpiece to be machined can be moved relative to one another in the cutting direction. Such tooling machines make it possible to produce several spaced parallel dividing cuts concurrently. Thus, for example, on tooling machines with two cutting units, workpieces can be cut at the same time. However, the cutting speeds at which cuts with high-quality edges can be produced with the known process and the known machine tools need to be increased.

It is an object of the present invention to provide a novel process for cutting workpieces with a pair of beams, and a machine tool for carrying out this process, by means of which good-quality cut edges can be achieved at a high cutting speed.

SUMMARY OF THE INVENTION

It has now been found that the foregoing and related objects can be readily attained by providing a machine tool which includes at least two cutting beams which are directed at the workpiece to be machined in such a way that the beam axes intersect and/or the beam axes are adjacent one another along the cutting line. In developing the process of the invention, it was surprisingly found that the results that could be achieved with a cutting beam could be greatly improved and that the cutting speed could be increased without affecting the quality of the cut if at least a pair of cutting beams were used and the cutting beams were at an angle and/or intersected at the cutting line directly adjacent the workpiece to be machined. For a given cut quality, doubling the cutting speeds with this process compared to the conventional beam-cutting process is not a problem. A conceptual model for explaining the phenomenon observed assumes that, if two cutting beams disposed at an angle to one another are used, the cutting beam supports the other and that in this way the cutting effect of at least one of the cutting beams is enhanced by preventing lateral breaking away of the cutting beam opposite the workpiece being machined because of the supporting effect. A "directly adjacent" arrangement of the cutting beams exists, in the sense of the present invention, if the distance between the point where the cutting beams meet on the cutting line is small, so that the enhancement of the cutting effect of at least one of the cutting beams is achieved.

In cases where the axes of the cutting beams in the invention run directly adjacent to one another on the cutting line, the axes can be aligned basically parallel to one another; but it is a special advantage in terms of cutting speed and the quality of the cutting edges if the cutting beams are aimed at the workpiece in such a way that the axes of the beams intersect under the cutting plane. Here, the cutting plane is defined by the tangential plane on the workpiece in the respective machining point.

One preferred embodiment of the process of the present invention is characterized by the fact that the cutting beams are aimed at the workpiece in such a way that the axes of the beams intersect below the cutting plane.

Superior machining results can be achieved by aiming the first cutting beam basically perpendicularly to the workpiece and the second cutting beam at an angle deviating from a right angle. But alternatively, two cutting beams can also be aimed at the workpiece at an angle deviating from a right angle.

To achieve a high cutting speed and good quality for the cut edges, it has proved useful for one cutting beam, if necessary preferably the perpendicular cutting beam, to be aimed at the workpiece in front of another cutting beam in the cutting direction. Preferably in cases where the axes of the cutting beams intersect below the workpiece, the cutting beam plane covered by the beam axes runs in the cutting direction.

Another variation of the process is characterized by the fact that two cutting beams are aimed at the workpiece in such a way that the beam axes intersect at an angle of less than 60°.

Basically, the advantages of the process of the present invention can be achieved with cutting beams provided by different cutting characteristics or media. In one preferred embodiment of the process of the present invention, cutting beams in the form of pressurized water jets, preferably containing abrasive media, are aimed at the workpiece. The pressurized water jets are aimed at the workpiece and have a pressure of 2800 to 3400 bar for this purpose.

One preferred version of the process of the present invention is characterized by the fact that only one cutting beam is aimed at the workpiece for the initial cutting and another cutting beam is aimed at it after the workpiece has been cut through by the first beam.

For this purpose, the one cutting beam and the workpiece are moved at a relatively slow relative speed for the initial cutting of the workpiece, and the relative speed is increased up to the the final cutting speed after the other cutting beam has been directed at and impinges upon the workpiece.

The aforementioned object of providing a machine tool for the practice of the process is solved by providing the cutting units on existing types of machine tools in which the workpiece and cutting head are relatively movable in operation at the same time so that there is relative movement along a common cutting line of the cutting units and workpiece. The cutting units should be arranged and aligned in such a way that the cutting beams they emit impinge upon the workpiece to be machined in the manner described above.

To permit a variation of the arrangement of the cutting beams to one another, one advantageous embodiment of the machine tool of the present invention provides at least one cutting unit which can pivot around a pivot axis basically parallel to the cutting plane together with another cutting unit cooperating with it, and the pivoted cutting unit can be fixed in the desired pivoted position. On this type of machine tool, the cutting beams can be directed generally parallel to one another or at changing angles to one another. The machine tool can then be adjusted for different requirements in use.

Another way of varying the path of the cutting beams to one another is provided by a version of the machine tool of the present invention in which the cutting units are arranged so they can move relative to one another basically parallel to the cutting plane, and preferably in the cutting direction.

When operating, the cutting beams are in a defined position in relation to the cutting direction. For example, when cutting with two parallel cutting beams or with two cutting beams intersecting at a point, the position of the cutting beams compared to the cutting direction is defined by the path of the cutting beam plane covered by the cutting beams as compared with the cutting direction. If the cutting direction is changed, the position of the cutting beams is maintained relative to the changed cutting direction. In both of these examples, the cutting beam plane must be altered relative to the workpiece for the purpose. Such a movement of the plane of the cutting beams is made possible in one preferred embodiment of the machine tool of the invention by the fact that at least one cutting unit can rotate relative to the workpiece around a pivot axis which is basically perpendicular to the cutting plane. A change in cutting direction and a rotating-pivoting movement associated with it by at least one cutting unit can be made both during the cutting operation and after an initial dividing cut has been made. In the first case, there is a curved dividing cut. In the second, another dividing cut can be made that extends outwardly from the finished cut and runs at an angle to it.

The machine tool is compact if the cutting units are on a common cutting head on the machine tool.

One preferred embodiment of the machine tool of the invention, is one in which pressurized water units are provided as the cutting units and there is a supply of abrasive for each pressurized water jet. In this manner, the cutting action of each of the cutting beams can be modified independently of the other.

Having the cutting units connected separately to the source of the cutting beam, as in the variation of the invention provided, also makes the machining flexible. Depending on the requirements in each specific case or depending on the phase of the cutting process, the cutting units can be operated together or individually.

One condition for automated workpiece machining is created by the fact that the cutting units may be controlled by control switches connected to the assigned source for the cutting beam.

According to the invention, machine tools whose cutting units can be connected to the assigned source of the cutting beam separately and/or by means of control switches are also used, for example, for converting from the type of variation of the process in the invention in which the workpiece being machined is cut with only one cutting beam and after that is worked on with two cutting beams.

Another preferred embodiment of a machine tool according to the invention has a speed control to control the relative speed of movement between the cutting units and the workpiece and the relative speed between the cutting units and the workpiece is controlled by means of the speed control which will provide a speed relative movement which depend on the number of cutting units that are providing cutting beams operating on the workpiece and/or the length of time the cutting units are functioning. Such a machine tool is also preferably intended for the two-phase cutting operation described above. In the initial cutting phase in which only one cutting beam is aimed at the workpiece, the speed control sets a relatively slow speed of relative movement between the cutting unit in operation and the workpiece. In this phase, the machine tool of the invention works by the conventional process where the dividing cut is made by means of a single machining beam.

After the initial cutting has been completed, the cutting beam of the second cutting unit disposed behind the cutting beam of the first cutting unit cuts the workpiece. Now, the cutting speed can be increased. Since the second cutting beam reaching the workpiece after the initial cut does not go fully into effect immediately upon reaching the workpiece, it is convenient if the cutting speed, hence the speed of relative movement between the cutting units and the workpiece, is not increased abruptly, but rather gradually, as soon as the second cutting unit has reached the workpiece. This is brought about by the speed control which gradually increases the speed of relative movement between the cutting units and the workpiece after the second cutting unit goes into effect. With corresponding control of the cutting units, the second cutting unit, the cutting beam of which is behind the first, can be connected to the source for the cutting beam only after the end of the initial cutting by the first cutting beam which precedes it in the cutting direction. In this case, during the initial cutting phase, a cutting beam is emitted by only one cutting unit.

DETAILED DESCRIPTION OF THE PREFERRED EMBODIMENT

Figure 1:
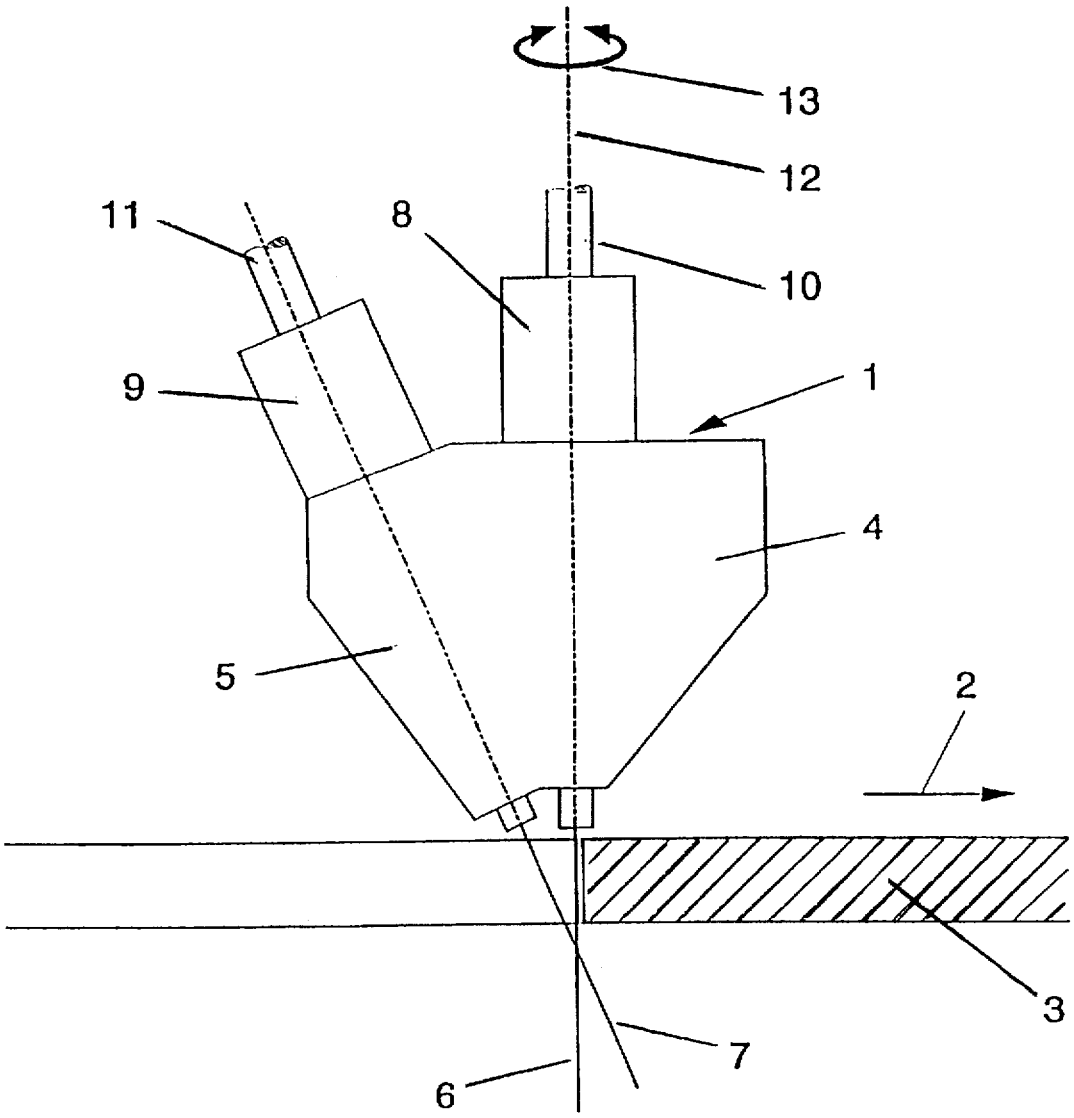
FIG. 1 shows a cutting head of a water-jet cutting machine a embodying the present invention with a cutting head having two cutting units in one body.

FIG. 1 shows a cutting head 1 of a water-jet cutting machine which is movable in the direction of the arrow 2 relative to a stationary workpiece 3 in the form of a sheet-metal plate. The cutting head 1 is supported in the holder of a machine tool slide or carriage (not shown) overlying the sheet-metal plate 3. The machine tool carriage or slide can be moved along the length of sheet-metal plate 3. At the same time, the cutting head 1 can be controlled and moved in the longitudinal direction of the holder and thus transversely of the direction in which the machine tool slide moves. The cutting head 1 can, in this way, reach each point in the plane of the sheet-metal plate 3.

Built into the cutting head 1 are two cutting units 4, 5 which act on the sheet-metal plate 3 during the cutting operation by projecting cutting beams 6, 7 which in this embodiment are high-pressure water jets whose axes intersect under the cutting plane. The cutting unit 4 aims its cutting beam at a basically right angle to the surface of the sheet-metal plate 3. The cutting beam 7 emitted by the cutting unit 5 is disposed at an angle deviating from a right angle to the surface of the workpiece 3. The cutting beams 6, 7 and their axes cover a cutting beam plane that runs perpendicular to the sheet-metal plate 3.

The cutting units 4, 5 are connected to a high-pressure pump (not shown) by fittings 8, 9 and high-pressure lines 10,11 as schematically illustrated in FIG. 1. The whole cutting head 1 can be pivoted about a pivot axis 12 extending in the direction of the axis of the cutting beam 6 as indicated by the direction of the arrow 13.

Now if a dividing cut is to be made in the sheet-metal plate 3 by means of the cutting head 1, the cutting units 4, 5 are connected to the high-pressure pump. The cutting beam 6 emitted by the cutting unit 4 is ahead of the cutting beam 7 emitted by the cutting unit 5 in the cutting direction, i.e., in the direction of arrow 2. The cutting beam 6 emitted by the cutting unit 4 penetrates the sheet-metal plate 3 and produces the initial cut as the cutting head 1 is moved in the cutting direction symbolized by the arrow 2. As soon as the initial cut has been made, the cutting beam 7 emitted by the cutting unit 5 also impinges upon the sheet-metal plate 3. After the cutting beam 7 has reached the sheet-metal plate 3, the speed of the cutting head 1 starting from a relatively low initial cutting speed is increased to the final cutting speed. Also during the subsequent cutting process, the cutting beam 6 emitted by the cutting unit 4 is directed at the sheet-metal plate 3 in front of the cutting beam 7 in the cutting direction 2. The cutting beam plane covered by the cutting beams 6, 7 runs in the cutting direction. The pressure of the cutting jet streams 6, 7 is around 3000 bar.

To change the cutting direction, the cutting head 1 is pivoted about the pivot axis 12. This way, the cutting machine shown can also make curved dividing cuts and straight cuts at an angle to one another.

Figure 2:
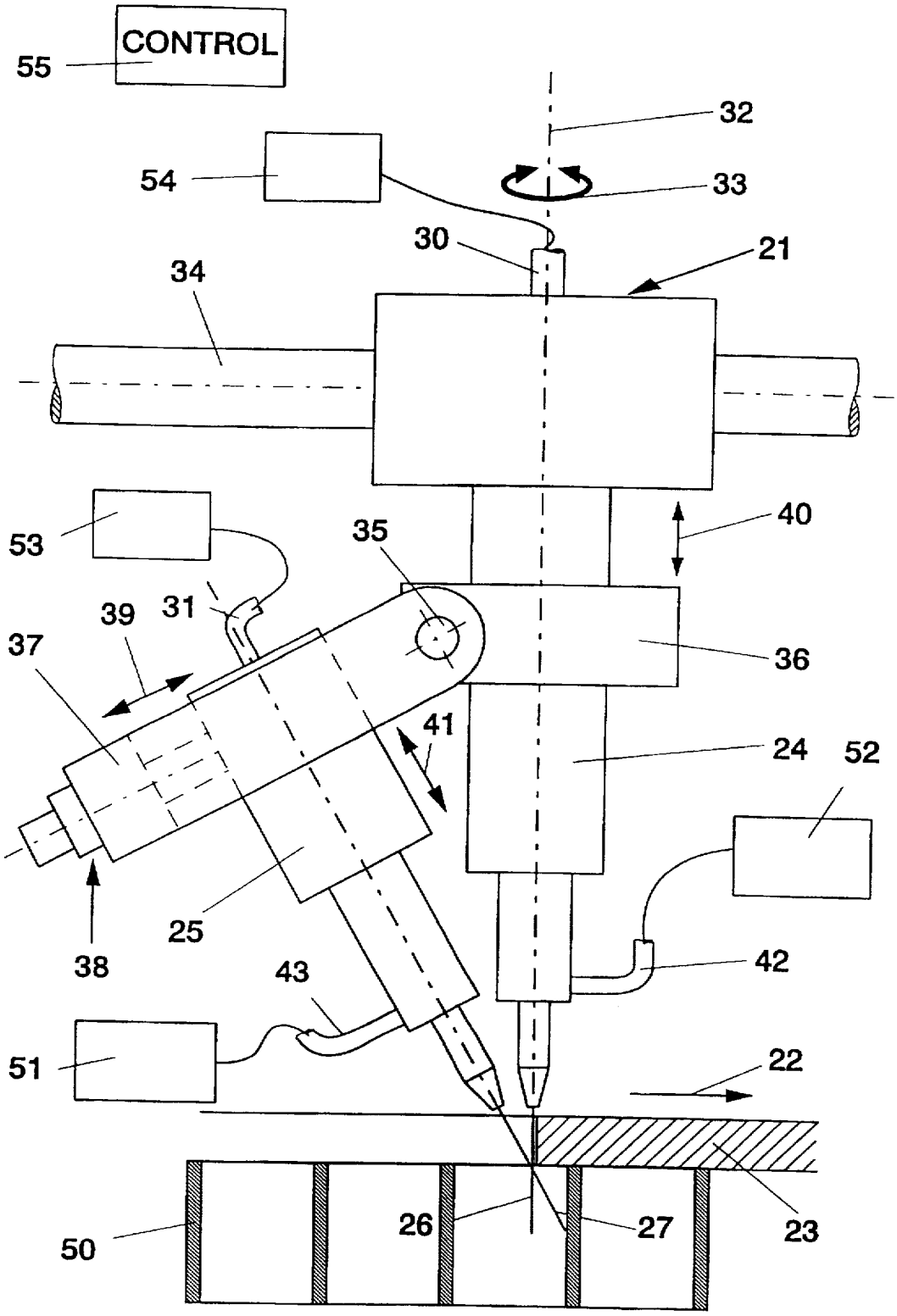
FIG. 2 shows an alternate embodiment of a cutting head of a water-jet cutting machine with a cutting head having separate cutting units so that one may be moved relative to the other.

The cutting machine partially shown in FIG. 2 has a cutting head 21 with two separate cutting units 24, 25. The cutting head 21 is motor-driven and can move along the holder or rail 34 of a machine tool slide in the direction of the arrow 22 symbolizing the cutting direction, over the workpiece 23 in the form of a sheet-metal plate which is supported on the fragmentarily illustrated grid-like worktable 50.

The cutting units 24, 25 are connected to one another so that the unit 25 can pivot about an axis 35 running basically parallel to the plane of the sheet-metal plate 23, i.e., to the cutting plane. Clamp-like holders 36,37 which surround the cutting units 24, 25 are used to make the pivotal connection therebetween. The cutting unit 25 inside its holder 37 can be adjusted in the direction of the double arrow 39 by means of a spindle drive 38. The cutting unit 25 can also be moved in the direction of the double arrow 41. The holder 36, which surrounds the cutting unit 24, can be moved in the direction of a double arrow 40 basically perpendicularly to the plane of the sheetmetal plate 23. The whole cutting head 21 can be pivoted by a motor (not shown) about the pivot axis 32 in the direction of the double arrow 33.

When in operation, the cutting units 24, 25 direct the cutting beams 26, 27, shown in FIG. 2, at the surface of the sheet-metal plate 23. The cutting beam 26 of the cutting unit 24 basically extends perpendicularly to the surface of the workpiece 23 and the cutting beam 27 of the cutting unit 25 extends at an angle deviating from a right angle with the workpiece surface. The two cutting beams 26, 27 intersect in the cutting plane and cover a cutting beam plane running in the direction of the arrow 22 in the cutting direction.

The cutting beams 26, 27 are produced by means of pressurized water for cutting which is fed to the cutting units 24, 25 through high-pressure lines 30, 31 from the pumps 53, 54 to produce jets which impinge on the workpiece 23. To vary the cutting effect, the cutting beams 26, 27 can include in the jets abrasives which are fed through-lines 42, 43. Each of the cutting beams 26, 27 has its own abrasive supply 51, 52. In this manner, the characteristics of the cutting beams 26,27 can be adjusted to the requirements of the individual case.

The capabilities for adjusting the cutting units 24, 25 previously described are also used to adjust to different working conditions. Thus, by pivoting the cutting unit beams 26, 27, the cutting axes can be changed. By moving the cutting unit 25 in the direction of the double arrow 39, the position of the point of intersection of the cutting beams 26, 27 in relation to the plane of the sheet-metal plate 23 can be varied. One way of positioning the cutting unit 25 relative to the surface of the sheet-metal plate 23 is offered by the adjustability of the cutting unit 25 in the direction of the double arrow 41. An adjustment of the cutting unit 25 in the direction of the double arrow 39 involves an adjustment in the cutting unit 25 in the direction of the double arrow 41, if the position of the point of intersection of the cutting beams 26, 27 and their axes is changed in relation to the sheet-metal plate 23, but the distance between where the beam comes out of the cutting unit 25 and the sheet-metal plate 23 should remain the same.

The machine tool in FIG. 2 basically works the same as the embodiment described above and shown in FIG. 1. Both machine tools are also suitable for machining workpieces to provide curved cuts.

The control 55 allows the operator to control the various valves, switches and motors, either manually or by computer program.

I claim:

1. A machine tool for cutting workpieces having:

(a) a worktable for supporting a workpiece;

(b) a carriage movable over and along said worktable;

(c) a cutting head supported on said carriage and having at least two cutting units for emitting cutting beams directed at a workpiece supported on said worktable, said cutting units being oriented to direct their cutting beams to impinge on the surface of the workpiece adjacent each other to cooperate in effecting a cut of the workpiece along a cutting line;

(d) means for providing cutting beams from each of said cutting units and for directing said cutting beams to intersect at a point spaced from the surface of the workpiece in the direction opposite from the cutting head; and (e) means for moving said carriage over said worktable for cutting the workpiece along a cutting line.

2. The machine tool according to claim 1 in which at least one of said cutting units is pivotable about an axis extending substantially parallel to the plane of said worktable.

3. The machine tool according to claim 1 wherein said cutting units are mounted on said cutting head so that one of said cutting units may be pivoted about another of said cutting units on an axis substantially perpendicular to the surface of said worktable.

4. The machine tool according to claim 1 wherein at least one of said cutting units is mounted on said cutting head so that it can rotate and pivot relative to said worktable about a rotary-pivoting axis extending substantially perpendicularly to the cutting plane.

5. The machine tool according to claim 1 wherein said mmeans providing cutting beams is a pressurized water supply.

6. The machine tool according to claim 5 wherein separate pressurized-water supply units are provided for each of said cutting units.

7. The machine tool according to claim 1 wherein said cutting units can be connected separately to said means for providing the cutting beams.

8. The machine tool according to claim 1 wherein there is included control means for connecting said cutting units to said means for providing the cutting beams.

9. The machine tool according to claim 8 wherein said control means includes a speed control to control the speed of relative movement between said cutting units and the workpiece and the supply from said means for providing said cutting beams.

10. (Amended) A machine tool for cutting workpieces having:

(a) a worktable for supporting a workpiece;

(b) a carriage movable over and along said worktable;

(c) a cutting head supported on said carriage and having at least two cutting units for emitting cutting beams directed at a workpiece supported on said worktable, said cutting units being oriented to direct their cutting beams to impinge on the surface of the workpiece adjacent each other to cooperate in effecting a cut of the workpiece along a cutting line, said cutting heads being oriented to cause their beams to intersect at a point spaced from the surface of workpiece in the direction opposite from said cutting head;

(d) means for providing cutting beams from each of said cutting units;

(e) means for moving said carriage over said worktable for cutting the workpiece along a cutting line; and (f) control means for initially directing only one cutting beam upon the workpiece to commence cutting thereof and thereafter for directing the other of said cutting beams upon the workpiece to cooperate with said one cutting beam in further cutting of the workpiece.

11. The machine tool according to claim 10 wherein said means providing cutting beams is a pressurized water supply.

12. The machine tool according to claim 10 wherein separate pressurized-water supply units are provided for each of said cutting units.

13. A machine tool for cutting workpieces having:

(a) a worktable for supporting a workpiece;

(b) a carriage movable over and along said worktable;

(c) a cutting head supported on said carriage and having at least two cutting units for emitting cutting beams directed at a workpiece supported on said worktable, said cutting units being oriented to direct their cutting beams to impinge on the surface of the workpiece adjacent each other to cooperate in effecting a cut of the workpiece along a cutting line;

(d) means for providing cutting beams from each of said cutting units, one of said beams being directed along an axis perpendicular to the surface of the worktable and the other of said being directed along an axis at an angle deviating from a right angle; and (e) means for moving said carriage over said worktable for cutting the workpiece along a cutting line, and for directing a first cutting beam to impinge upon the workpiece ahead of the second cutting beam along the cutting line.

14. The machine tool according to claim 13 wherein said means providing cutting beams is a pressurized water supply.

15. The machine tool according to claim 13 wherein separate pressurized-water supply units are provided for each of said cutting units.

* * * * *